US007682051B2

(12) United States Patent
Xiao et al.

(10) Patent No.: US 7,682,051 B2
(45) Date of Patent: Mar. 23, 2010

(54) LAMP ASSEMBLY HAVING A JUNCTION BOX

(75) Inventors: Xu-Hua Xiao, Shenzhen (CN); Yi-San Liu, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 146 days.

(21) Appl. No.: 11/959,169

(22) Filed: Dec. 18, 2007

(65) Prior Publication Data

US 2009/0154171 A1 Jun. 18, 2009

(51) Int. Cl.
*F21V 15/00* (2006.01)

(52) U.S. Cl. ..... 362/364; 362/800

(58) Field of Classification Search ..... 362/294, 362/373, 365, 147, 249.02, 249.11, 364, 362/368

See application file for complete search history.

(56) References Cited

U.S. PATENT DOCUMENTS 5,057,979 A * 10/1991 Carson et al. ..... 362/147
6,369,326 B1 * 4/2002 Rippel et al. ..... 174/58
6,929,389 B1 * 8/2005 Rhee ..... 362/490
7,264,370 B2 9/2007 Clanton
7,438,433 B1 * 10/2008 Steadman et al. ..... 362/147
2007/0041220 A1 * 2/2007 Lynch ..... 362/646
2007/0268707 A1 * 11/2007 Smester ..... 362/362
2008/0165535 A1 * 7/2008 Mazzochette ..... 362/294
2008/0278950 A1 * 11/2008 Pickard et al. ..... 362/294
2008/0285271 A1 * 11/2008 Roberge et al. ..... 362/235
2008/0304269 A1 * 12/2008 Pickard et al. ..... 362/365
2009/0086476 A1 * 4/2009 Tickner et al. ..... 362/231
2009/0097262 A1 * 4/2009 Zhang et al. ..... 362/364
2009/0135608 A1 * 5/2009 Sell ..... 362/365

* cited by examiner

*Primary Examiner*—Jong-Suk (James) Lee
*Assistant Examiner*—David R Crowe
(74) *Attorney, Agent, or Firm*—Frank R. Niranjan

(57) ABSTRACT

A lamp assembly includes a lamp and a junction box. The lamp defines a front chamber and a rear chamber. A plurality of LED modules is received in the rear chamber. A receiving member is located at a top of the front chamber. The junction box is mounted on an outside of the receiving member. A junction base is received in the junction box. A mounting tube extends through the junction box and the receiving member of the lamp to mount the junction box on the lamp. A connecting tube is mounted on the junction box. Wires of the LED modules extend through the mounting tube and connecting with the junction base. The connecting tube is adapted to receive wires extending from an outside power sources to the junction base.

12 Claims, 4 Drawing Sheets

LAMP ASSEMBLY HAVING A JUNCTION BOX

BACKGROUND OF THE INVENTION

1. Field of the Invention

The present invention relates to a lamp assembly having a junction box, wherein the junction box is mounted on an outside of a lamp of the lamp assembly.

2. Description of Related Art

A conventional lamp assembly comprises a lamp and a junction box connecting with the lamp. Wires of the lamp and an outside power sources are received in the junction box. The junction box is generated received in the lamp. Therefore, a volume of the lamp is required overlarge to store the junction box, which raises production costs. When wires received in the junction box are necessary to change, the lamp must be disassembled, which is unduly troublesome.

What is needed, therefore, is a lamp assembly having a junction box, wherein the junction box is mounted on an outside of a lamp of the lamp assembly.

SUMMARY OF THE INVENTION

A lamp assembly includes a lamp and a junction box. The lamp defines a front chamber and a rear chamber. A plurality of LED modules is received in the rear chamber. A receiving member is located at a top of the front chamber. The junction box is mounted on an outside of the receiving member. A junction base is received in the junction box. A mounting tube extends through the junction box and the receiving member of the lamp to mount the junction box on the lamp. A connecting tube is mounted on the junction box. Wires of the LED modules extend through the mounting tube and connecting with the junction base. The connecting tube is adapted to receive wires extending from an outside power sources to the junction base.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
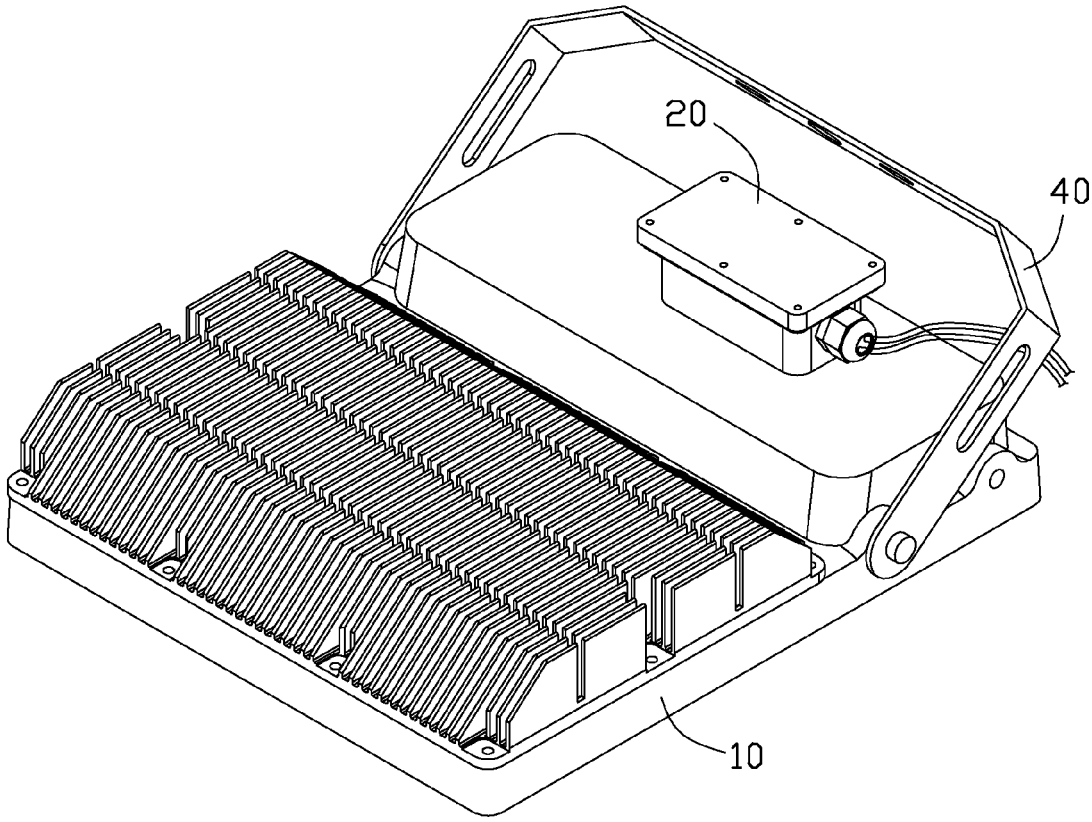
FIG. 1 is an assembled view of a lamp assembly in accordance with a preferred embodiment of the present invention.
Figure 2:
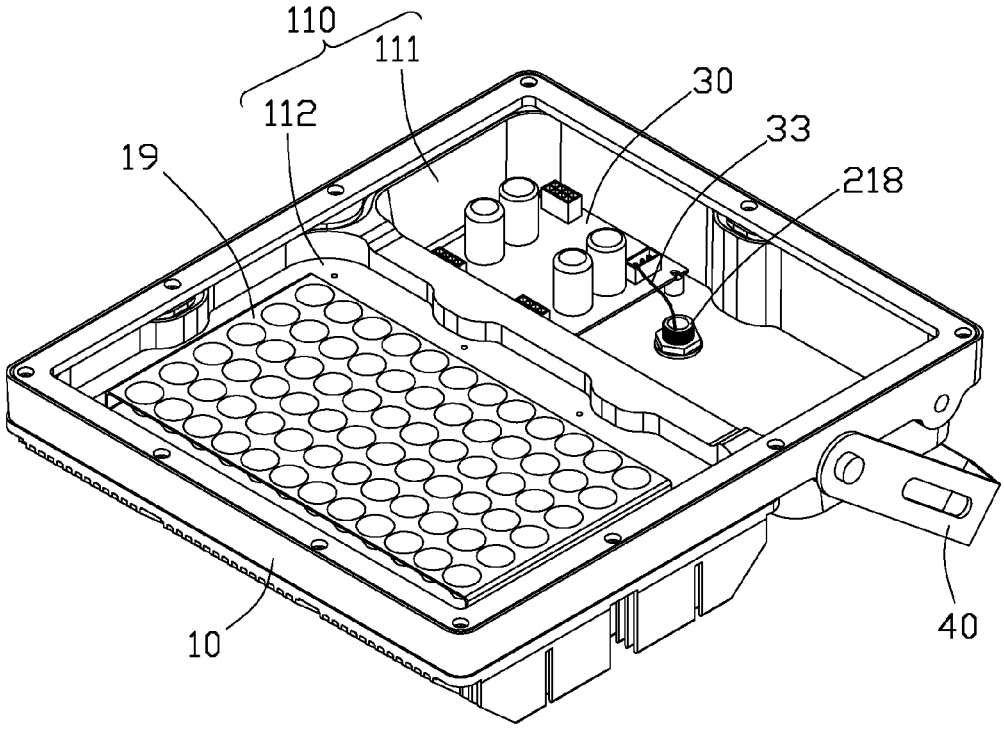
FIG. 2 is similar to FIG. 1, but viewed in different aspect.

Referring to FIGS. 1-2, a lamp assembly in accordance with a preferred embodiment of the present invention comprises an LED lamp 10, a junction box 20 mounted on the LED lamp 10 and a bracket 40 pivotally connecting with the LED lamp 10.

Figure 3:
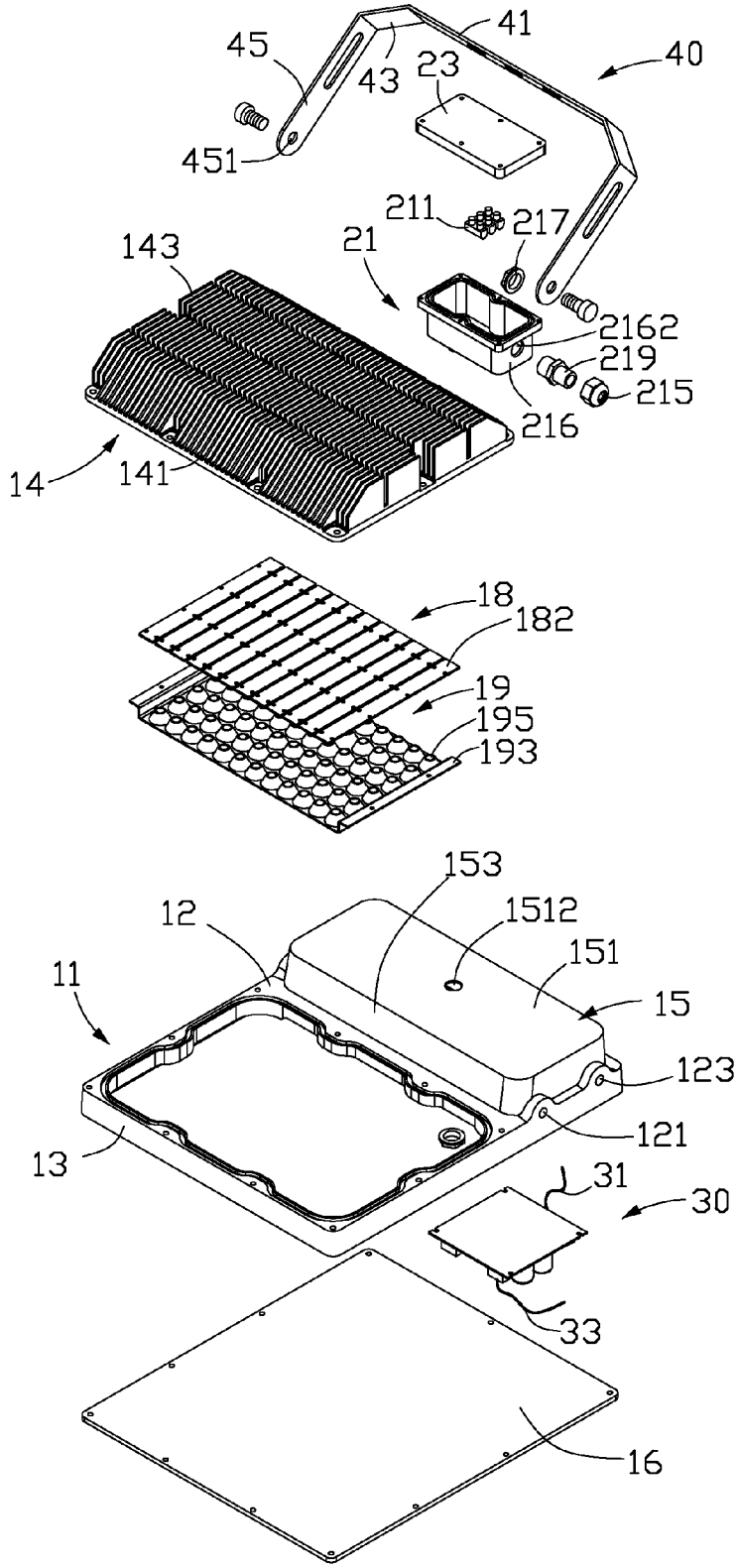
FIG. 3 is an exploded view of FIG. 1.

Referring to FIG. 3 also, the LED lamp 10 defines a rectangular and hermetical chamber 110. The chamber 110 is enclosed by a heat sink 14, a frame 11 located a bottom side of the heat sink 14 and a transparent glass or plastic flat lampshade 16 parallel to the heat sink 14. The frame 11 comprises two pairs of opposite sidewalls 12, 13 connecting with the heat sink 14 and the lampshade 16. Each sidewall 12 defines two spaced screw holes 121, 123 at front end thereof. The chamber 110 is divided into a front chamber 111 and a rear chamber 112 by a crossbeam 17 connecting with the sidewalls 12. A receiving member 15 protrudes upwardly from the front chamber 111. The heat sink 14 connects with a rear portion of the sidewalls 12, 13 and the crossbeam 17 to define the rear chamber 112. A plurality of LED modules 18 is received in the rear chamber 112 and mounted on the bottom of the heat sink 14. A reflector 19 is mounted on the bottom of the heat sink 14 and covers the LED modules 18. A bracket 40 is mounted on a front end of the sidewalls 12 to mount the LED lamp 10 on a mounting member (not shown) such as a wall.

The heat sink 14 comprises a base 141 and a plurality of fins 143 perpendicularly extending outwardly from a top surface of the base 141. The fins 143 are parallel to and spaced from each other. The fins 143 are arranged in multiple rows and columns. A bottom surface of the base 141 thermally contacts with the LED modules 18 to cool down the LED modules 18 to keep them working within an acceptable temperature range. A plurality of screw holes (not labeled) is defined at edges of the base 141. A plurality of screws extends through the screw holes to be engaged in the sidewalls 12, 13 of the LED lamp 10 to secure the heat sink 14 on the LED lamp 10.

Each LED module 18 comprises an elongated printed circuit board 182 and a plurality of spaced LEDs 184 evenly mounted on a side of the printed circuit board 182 and toward the reflector 19. The LEDs 184 of each LED module 18 are arranged along a longitudinal direction of the printed circuit board 182. Each LED module 18 is mounted in a thermally conductive relationship with the bottom surface of the base 141 of the heat sink 14.

The reflector 19 is a metal sheet bent at two lateral ends. The reflector 19 comprises an elongated reflecting plate 191 and two mounting plates 193 extending downwardly and outwardly from lateral edges of the reflecting plate 191. The mounting plates 193 are secured on opposite edges of the base 141 of the heat sink 14. The reflecting plate 191 is located at a bottom of the LED modules 18. A plurality of reflecting holes 195 is defined in the reflecting plate 191, corresponding to the LEDs 184 to reflect light emitted by the LEDs 184.

The bracket 40 is a substantially U-shaped metallic flat sheet and comprises an elongated securing portion 41, two connecting portions 43 extending slantwise and outwardly from opposite ends of the securing portion 41 and two parallel mounting portions 45 extending downwardly from free ends of the connecting portions 43. Screws (not shown) extend through the securing portion 41 and engage with the mounting member to mount the LED lamp 10 on the mounting member. Each mounting portion 45 has a through hole 451 defined at a lower end thereof. Screws (not shown) extend through the through holes 451 to be engaged in the screw holes 121 or screw holes 123 to mount the bracket 40 on the LED lamp 10.

The receiving member 15 is a rectangular house and comprises an elongated top plate 151 and two pairs of sidewalls 153 extending downwardly from edges of the top plate 151. The top plate 151 defines a central hole 1512 at a centre thereof. A driving circuit module 30 is mounted on a bottom surface of the top plate 151. The driving circuit module 30 has a plurality of wires 31, 33. The wires 31 electronically connect with the LED modules 18.

Figure 4:
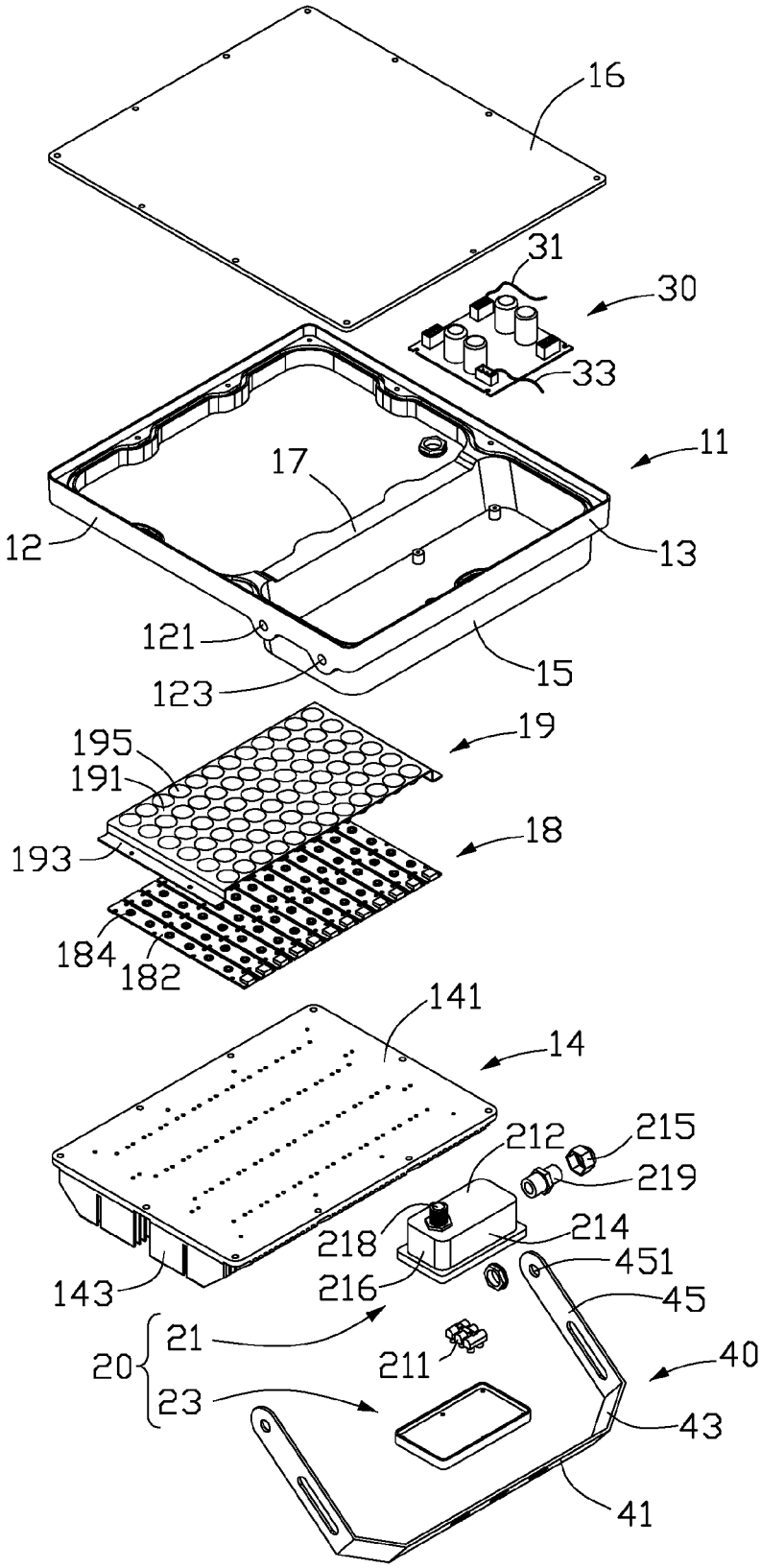
FIG. 4 is similar to FIG. 3, but viewed in different aspect.

Referring to FIG. 3 and FIG. 4, the junction box 20 is a rectangular box and comprises a house 21 and a cover 23 engaging with a top of the house 21. The house 21 comprises a bottom plate 212 towards the top plate 151 of the receiving member 15 and two pairs of sidewalls 214, 216 extending upwardly from edges of the bottom plate 212. A junction base 211 with a plurality of terminals (not labeled) is mounted on a top surface of the bottom plate 212 of the house 21. A mounting tube 218 is mounted on the bottom plate 212 of the house 21. The mounting tube 218 terminates with a screwed end (not labeled). The screwed end of the mounting tube 218 extends through the central hole 1512 of the receiving member 15 and threadedly engages with a nut (not labeled) to mount the house 21 of the junction box 20 on the top surface of the top plate 15 of the receiving member 15. Wires 33 (shown in FIG. 2) of the driving circuit board 30 extend through the tube 218 and connect with the terminals of the junction base 211. Thus, the LED modules 18, the driving circuit module 30 and the junction box 20 are connected together. One of the sidewalls 216 defines a through hole 2162 at a central portion thereof. A connecting tube 219 extends through the through hole 2162 of the sidewall 216 and is secured on the sidewall 216. The connecting tube 219 has two opposite screwed ends (not shown). The screwed ends of the connecting tube 219 threadedly engage with a nut 217 located at an inner of the house 21 and a screw cap 215 located at an outside of the house 21. A plurality of wires (shown in FIG. 1) of an outside power sources extends through the connecting tube 219 and connects with the terminals of the junction base 211. Thus, the driving circuit module 30 and the outside power sources electronically connect with each other. When the wires 33 is needed to reconnect terminals, an operator only open the cover 23 of the junction box 20 to operate terminals.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A lamp assembly comprising:

a lamp defining a front chamber and a rear chamber, a plurality of LED modules received in the rear chamber, a receiving member located at a top of the front chamber; and a junction box mounted on a top surface of the receiving member, a junction base received in the junction box, a mounting tube extending through the junction box and the receiving member of the lamp to mount the junction box on the receiving member, a connecting tube mounted on the junction box, wires of the LED modules extending through the mounting tube and connecting with the junction base, the connecting tube adapted to receive wires extending from an outside power sources to the junction base;

wherein the lamp comprises a frame defining the front and rear chambers therein, and the front chamber is separated from the rear chamber by a crossbeam connecting with two opposite sidewalls of the frame.

2. The lamp assembly as claimed in claim 1, wherein the junction box comprises a house and a cover engaging with the house.

3. The lamp assembly as claimed in claim 2, wherein the house of the junction box comprises a top plate and two pairs of sidewalls extending upwardly from edges of the top plate, the mounting tube is mounted on the top plate and the connecting tube is mounted on one of the sidewalls.

4. The lamp assembly as claimed in claim 1, wherein the receiving member is a rectangular house, a driving circuit board is received in the receiving member.

5. The lamp assembly as claimed in claim 1, wherein a heat sink is located at a top of the rear chamber, the heat sink comprises a base, the LED modules are mounted on the base of the heat sink.

6. The lamp assembly as claimed in claim 5 further comprising a reflector mounted on the heat sink and the reflector corresponds to the LED modules to reflect light emitted by the LED modules.

7. The lamp assembly as claimed in claim 1 further comprising a bracket mounted on a front end of the lamp.

8. A lamp assembly comprising:

a frame;

a heat sink mounted on the frame;

a plurality of LED modules attached to a bottom of the heat sink;

a lampshade coupled to the frame to cooperatively define a chamber for receiving the LED modules therein; and an outer junction box mounted the frame and located at a side of the heat sink to receive wires of the LED modules;

wherein a receiving member protrudes upwardly from the frame, the junction box mounted on a top surface of the receiving member; and wherein the frame and the lampshade cooperatively define a first chamber and a second chamber separated from the first chamber by a crossbeam connecting with two opposite sidewalls of the frame, the receiving member located at the first chamber and the heat sink located at the second chamber.

9. The lamp assembly as claimed in claim 8, wherein a mounting tube protrudes downwardly from a bottom of the junction box to be threadedly engaged in the receiving member, the wires of the LED modules enters into the junction box by extending through the mounting tube.

10. A lamp assembly, comprising:

a frame defining a first opening and a second opening adjacent to the first opening;

a receiving member protruding from the first opening;

a heat sink mounted on the frame at the second opening;

a plurality of LED modules mounted on a bottom of the heat sink;

a junction box mounted on a top of the receiving member to receive wires of the LED modules; and a cover coupled to the frame to cooperatively define a chamber to receive the LED modules therein;

wherein the first opening is separated from the second opening by a crossbeam connecting with two opposite sidewalls of the frame.

11. The lamp assembly as claimed in claim 10, wherein a mounting tube extends through the junction box and the receiving member of the lamp to mount the junction box on the lamp.

12. The lamp assembly as claimed in claim 11, wherein the junction box comprises a top plate, two pairs of sidewalls extending upwardly from edges of the top plate and a cover coupled to the sidewalls, the mounting tube mounted on the top plate.

* * * * *